United States Patent [19]

Verschaeve

[11] 4,194,248

[45] Mar. 25, 1980

[54] PROTECTIVE MITTEN

[76] Inventor: James A. Verschaeve, 52303 Chesterfield Rd., Mt. Clemens, Mich. 48043

[21] Appl. No.: 942,027

[22] Filed: Sep. 13, 1978

[51] Int. Cl.[2] ..... A41D 19/01

[52] U.S. Cl. ..... 2/158; 2/168

[58] Field of Search ..... 2/158, 159, 168

[56] References Cited

U.S. PATENT DOCUMENTS

| | | | |
|---|---|---|---|
| 1,053,204 | 2/1913 | Morrison | 2/158 |
| 1,507,707 | 9/1924 | Morganstern | 2/168 X |
| 1,580,857 | 4/1926 | Richards | 2/16 X |
| 2,069,643 | 2/1937 | Burke | 2/158 X |
| 2,074,762 | 3/1937 | Seyfried | 2/168 X |
| 2,141,739 | 12/1938 | Burke | 2/158 |
| 2,518,424 | 8/1950 | Kaas | 2/158 |
| 3,327,320 | 6/1967 | Forsyth | 2/158 |
| 3,740,262 | 6/1973 | Agostinelli | 2/159 X |

*Primary Examiner*—Louis Rimrodt
*Attorney, Agent, or Firm*—Basile and Weintraub

[57] ABSTRACT

A protective mitten or glove which allows a person to have moisture retained on their hands, but allows normal household activities or sleeping without soiling clothing or the surroundings.

1 Claim, 2 Drawing Figures

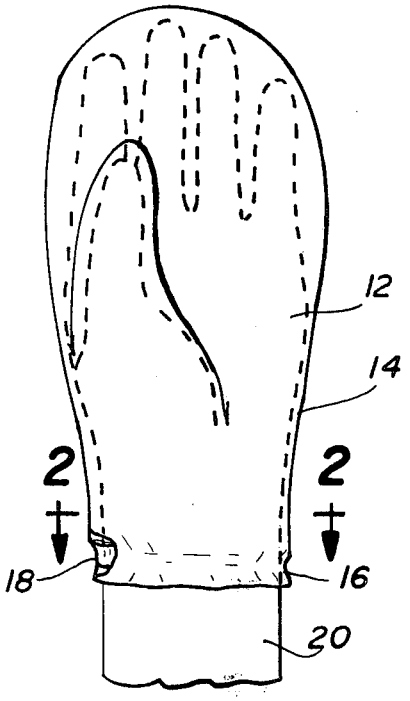
FIG-1
FIG-2
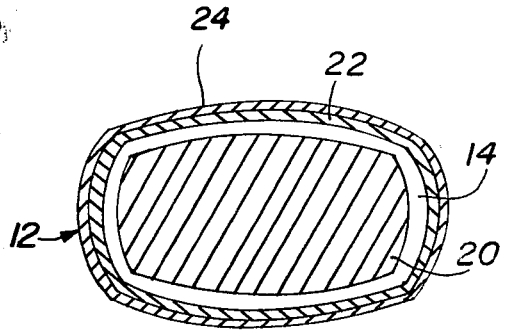

PROTECTIVE MITTEN

BACKGROUND OF THE INVENTION

I. Field of the Invention

The present invention relates to the field of protective garments, and in particular to the field of protective gloves or mittens.

II. Description of the Prior Art and Prior Art Statement

Patents relating to the present invention which the inventor has been able to discover are: U.S. Pat. Nos. 1,580,857; 3,327,320; 3,740,262; 2,518,424; and 1,053,204. U.S. Pat. No. 1,580,857 discloses a laminated glove, but it is a lamination of rubber and lead for protection against X-rays. U.S. Pat. No. 1,053,204 teaches the use of a double walled inflatable sac for use as a hygienic mitten to protect the hands from being injured or scratched during sleep. The other listed U.S. Patents relate to gloves or mittens intended for other purposes and their construction and use is only remotely related to the present invention.

SUMMARY OF THE INVENTION

It is one object of the present invention to provide a protective glove or mitten made from a laminated material. A further object of the present invention is to have the material next to the skin chosen to be moisture proof to retain moisture or perspiration within the glove or mitten. The outer material is chosen to be a woven fabric having a soft texture adding to the comfort of the user and allowing the handling of normal household items without undue slipping of the article grasped. A groove around the wrist portion of the glove or mitten provides a place to retain an elastic ring. The elastic ring is sized to hold the glove or mitten snugly around the wrist of the user preventing the emergence of the moisture or perspiration from within the glove.

Another embodiment of the present invention provides ventilation of the glove or mitten, yet the mitten still retains moist medication or cream within. In this embodiment a semi-permeable membrane is used as the inner material. This allows the free passage of air into and out of the glove or mitten, but retains the medication or cosmetic cream within.

Other objects, advantages, and applications of the present invention will become apparent to those skilled in the art of protective gloves or mittens when the accompanying description of one example of the best mode contemplated for practicing the invention is read in conjunction with the accompanying drawing.

BRIEF DESCRIPTION OF THE DRAWINGS

The description herein makes reference to the accompanying drawings wherein like reference numbers refer to like parts throughout the several views, and wherein:

FIG. 1 shows a mitten upon a persons hand constructed in accordance with the present invention; and FIG. 2 is a cross-sectional view taken along plane 2—2 of FIG. 1.

DESCRIPTION OF THE PREFERRED EMBODIMENT

Referring, now, to the drawing, and particular to FIG. 1 wherein there is illustrated a mitten 12 embodying the present invention. The mitten 12 fits loosely and comfortably over the hand of the wearer forming an air space 14. The loose fit over the hand created by the air space 14 allows the accumulation of perspiration and moisture on the hands, and when the hand is inserted into the glove or mitten the moisture is not wiped away. A groove 16 located above the wrist portion of the mitten brings the mitten into close proximity of the arm 20 above the wrist. An elastic ring 18 urges the mitten 12 inward and seals the lining of the mitten 12 to the arm at the groove 16.

Referring now to FIG. 2, the lining 22 of the mitten 12 is made from a moisture proof sheet material such as rubber, polyvinyl chloride, or polyethelene, to prevent the issuance of medication or the like covering the hands and soiling clothing or surrounding objects. The outer surface 24 of the mitten 12 is laminated to the lining 22. The outer layer 24 is made from a soft woven fabric such as cotton, nylon, polyester or a combination thereof depending on the useful functions the wearer may wish to undertake while wearing the mitten 12. If the wearer wishes to minimize the generation of static electricity, an outer layer of cotton would be used. If abrasion resistance is desired, a nylon or polyester fabric would be used for the outer layer 24.

The lining 22 could be made from a semi-permeable membrane which allows air to freely pass through the lining yet prevents the passage therethrough of liquid such as moisture created by normal perspiration of the hand. This embodiment of the present invention allows the free ventilation of the interior of the glove or mitten yet it prevents the issue of moisture therefrom.

While the description of the preferred embodiment describes a mitten, it is apparent to those skilled in the art of protective coverings for the hand that the novel features of the present invention would apply equally as well to a glove.

Having thus described my invention what I claim is:

1. A protective mitten for the hand when the same is coated with a moist medication, said mitten comprising:

an inner layer, fabricated of a material selected from a group of materials consisting of rubber, polyvinyl chloride, and polyethylene and wherein the inner material is a semi-permeable moisture-proof membrane allowing air to pass therethrough but retaining moisture within said mitten; and an outer layer fabricated from a material selected from a group of woven materials consisting of cotton, nylon and polyester or a combination thereof;

said inner and outer layers being laminated together to form a seamless mitten which defines a cavity therebetween to receive and loosely enclose said hand, said cavity having a first section adapted to receive the thumb of said hand and a second section adapted to receive the remaining fingers of said hand, said laminated layers having an opening through which said hand extends, said laminated layers having an elastic ring fitting around said opening to form a seal between said inner layer and the wrist of said hand for retaining the medication and perspiration within said cavity whereby said hand remains moist.

* * * * *